US009073359B2

(12) United States Patent
Nakajima

(10) Patent No.: US 9,073,359 B2
(45) Date of Patent: Jul. 7, 2015

(54) IMAGE FORMING APPARATUS

(75) Inventor: Mikito Nakajima, Ina (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 13/368,168

(22) Filed: Feb. 7, 2012

(65) Prior Publication Data

US 2012/0206528 A1 Aug. 16, 2012

(30) Foreign Application Priority Data

Feb. 15, 2011 (JP) ..... 2011-030074

(51) Int. Cl.
*B41J 29/38* (2006.01)
*B41J 11/00* (2006.01)
*B41J 3/54* (2006.01)

(52) U.S. Cl.
CPC ..... *B41J 11/002* (2013.01); *B41J 3/543* (2013.01)

(58) Field of Classification Search
CPC ..... B41J 29/38; B41J 11/002; B41J 3/543; B41J 11/0015; B41J 11/42; B41J 29/393
See application file for complete search history.

(56) References Cited

U.S. PATENT DOCUMENTS

| | | | | |
|---|---|---|---|---|
| 6,145,979 | A | 11/2000 | Caiger et al. | |
| 6,910,764 | B2 | 6/2005 | Nakajima | |
| 7,048,368 | B2 | 5/2006 | Hirai | |
| 7,152,970 | B2 * | 12/2006 | Hasebe et al. | 347/102 |
| 7,244,021 | B2 * | 7/2007 | Arai | 347/102 |
| 7,490,931 | B2 * | 2/2009 | Hasebe et al. | 347/102 |
| 7,837,319 | B2 * | 11/2010 | Rodin et al. | 347/102 |
| 2009/0115827 | A1 * | 5/2009 | Endo et al. | 347/102 |
| 2010/0271449 | A1 * | 10/2010 | Kusunoki | 347/102 |
| 2011/0096132 | A1 * | 4/2011 | Kobayashi et al. | 347/102 |

FOREIGN PATENT DOCUMENTS

| | | |
|---|---|---|
| JP | 64-024752 | 1/1989 |
| JP | 06-077858 | 11/1994 |
| JP | 2004-082452 | 3/2004 |
| JP | 2008-087211 | 4/2008 |
| JP | 2008-207369 | 9/2008 |
| JP | 2010-069682 | 4/2010 |
| JP | 2010-287547 | 12/2010 |
| JP | 2011-005789 | 1/2011 |

* cited by examiner

*Primary Examiner* — Manish S Shah
*Assistant Examiner* — Jeremy Delozier
(74) *Attorney, Agent, or Firm* — Workman Nydegger

(57) ABSTRACT

An image forming apparatus includes: a first head that discharges first light-curable ink; a light radiating unit that is positioned at one side from the first head in a predetermined direction and cures the first light-curable ink by radiating light to the first light-curable ink; a second head that is positioned at the one side from the light radiating unit in the predetermined direction and discharges second light-curable ink; and a control unit that causes an image to be formed on a medium by controlling the first head and the second head to discharge the light-curable ink while moving the position of the medium relative to the first head, the light radiating unit, and the second head to the one side in the predetermined direction.

6 Claims, 7 Drawing Sheets

IMAGE FORMING APPARATUS

This application claims the benefit of Japanese Application No. 2011-030074, filed Feb. 15, 2011, all of which are hereby incorporated by reference.

BACKGROUND

1. Technical Field

The present invention relates to an image forming apparatus.

2. Related Art

Among image forming apparatuses, there is a printer which uses ink (ultraviolet curable ink) that is cured when receiving ultraviolet rays (light). Further, a printer equipped with an irradiator that radiates ultraviolet rays between a plurality of heads discharging ultraviolet curable ink has been proposed (for example, see JP-A-2004-82452). According to the printer, it is possible to suppress different color ink from mixing or blurring, even if the colors of the ink discharged from the heads are different.

However, as described in JP-A-2004-82452, when an irradiator is disposed between heads and the distance between the heads is larger than the width of the irradiator, the distance between the heads is relatively long, such that the image forming region becomes long. Therefore, there is a problem in that the transport accuracy of a (recording) medium transported in the image forming region is decreased.

SUMMARY

An advantage of some aspects of the invention is to shorten an image forming region.

According to an aspect of the invention, there is provided an image forming apparatus including: a first head that discharges first light-curable ink; a light radiating unit that is positioned at one side from the first head in a predetermined direction and cures the first light-curable ink by radiating light to the first light-curable ink; a second head that is positioned at the one side from the light radiating unit in the predetermined direction and discharges second light-curable ink; and a control unit that causes an image to be formed on a medium by controlling the first head and the second head to discharge the light-curable ink while moving the position of the medium relative to the first head, the light radiating unit, the second head to the one side in the predetermined direction, in which the length between the first head and the second head in the predetermined direction is not more than the length of the light radiating unit in the predetermined direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

Figure 1:
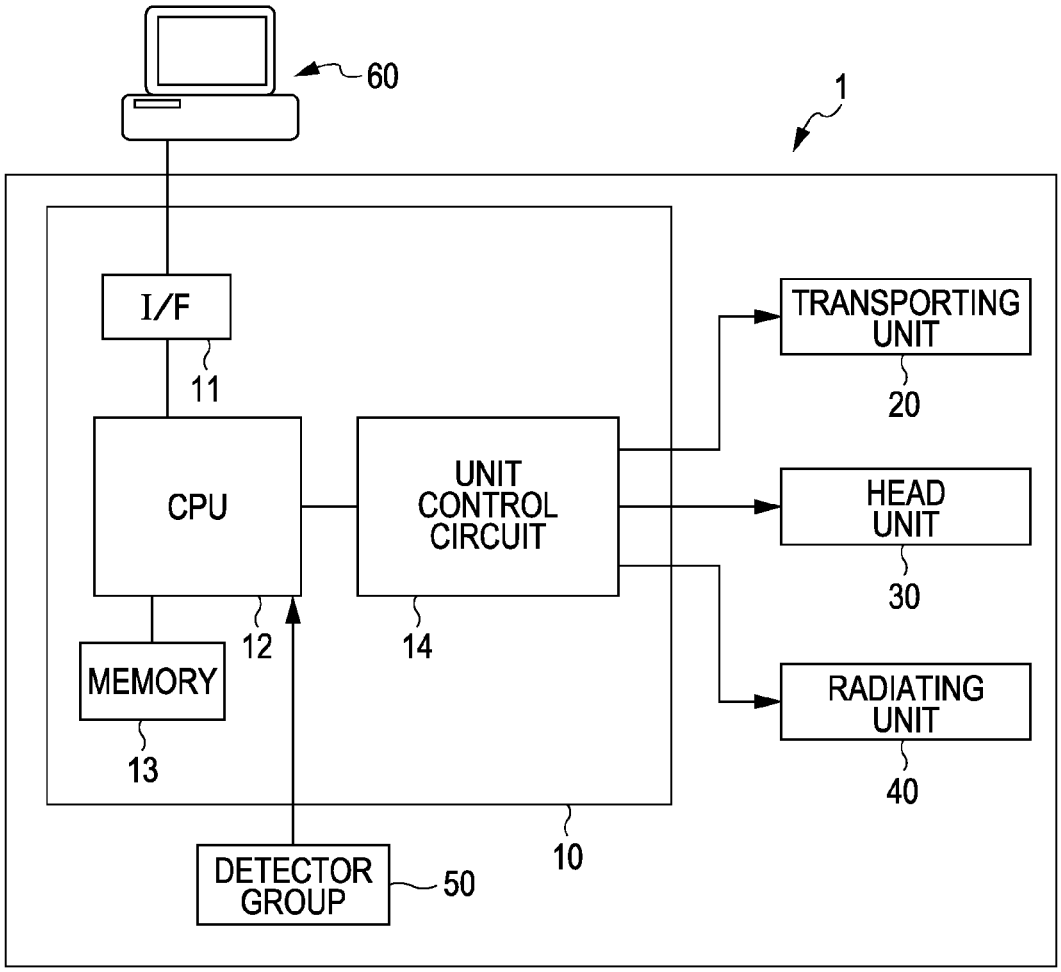
FIG. 1 is a block diagram showing the configuration of a printing system.

The followings will be made clear from the description of the specification and the accompanying drawings in the specification.

An image forming apparatus includes a first head that discharges first light-curable ink, a light radiating unit that is positioned at one side from the first head in a predetermined direction and cures the first light-curable ink by radiating light to the first light-curable ink, a second head that is positioned at the one side from the light radiating unit in the predetermined direction and discharges second light-curable ink, and a control unit that causes an image to be formed on a medium by controlling the first head and the second head to discharge the light-curable ink while moving the position of the medium relative to the first head, the light radiating unit, and the second head to the one side in the predetermined direction, in which the length between the first head and the second head in the predetermined direction is not more than the length of the light radiating unit in the predetermined direction.

According to the image forming apparatus, it is possible to reduce the length of the image forming region in a predetermined direction.

In the image forming apparatus, the distance between the first head and the second head in the predetermined direction may be not more than the length of a light radiation surface of the light radiating unit in the predetermined direction.

According to the image forming apparatus, it is possible to further reduce the length of the image forming region in a predetermined direction.

In the image forming apparatus, the light radiating unit may be shifted in a direction crossing the predetermined direction, with respect to the first head and the second head.

According to the image forming apparatus, it is possible to make the length between the first head and the second head in a predetermined direction not more than the length of the light radiating unit in a predetermined direction.

The image forming apparatus may further include a light guiding unit that guides the light from the light radiating unit to the first light-curable ink on the medium positioned between the first head and the second head.

According to the image forming apparatus, it is possible to effectively use the light from the light radiating unit in order to cure the first light-curable ink on the medium.

In the image forming apparatus, the light guiding unit may have a pair of reflective plates with the surfaces, which reflect the light from the light radiating unit, opposite to each other in the predetermined direction.

According to the image forming apparatus, since it is possible to guide the light from the light radiating unit to the first light-curable ink on the medium positioned between the heads, it is possible to effectively use the light from the light radiating unit.

In the image forming apparatus, the light radiating unit may be shifted away from the medium in the direction crossing the predetermined direction, with respect to the first head and the second head and the gap of the pair of reflective plates in the predetermined direction at predetermined position in the crossing direction, may be smaller than the gap of the pair of reflective plates in the predetermined direction at a position far from the predetermined position in the crossing direction.

According to the image forming apparatus, it is possible to increase radiation intensity of the light radiated to the first light-curable ink and it is also possible to effectively use the light from the light radiating unit.

In the image forming apparatus, the light guiding unit may include a lens that concentrates the light from the light radiating unit.

According to the image forming apparatus, it is possible to guide the light from the light radiating unit to the first light-curable ink on the medium positioned between the heads and it is also possible to increase the radiation intensity of the light radiated to the first light-curable ink.

Printing System

Hereinafter, assuming that an "image forming apparatus" is an ink jet printer (hereafter, printer), an embodiment is described by exemplifying a printing system with a printer and a computer connected.

Figure 2:
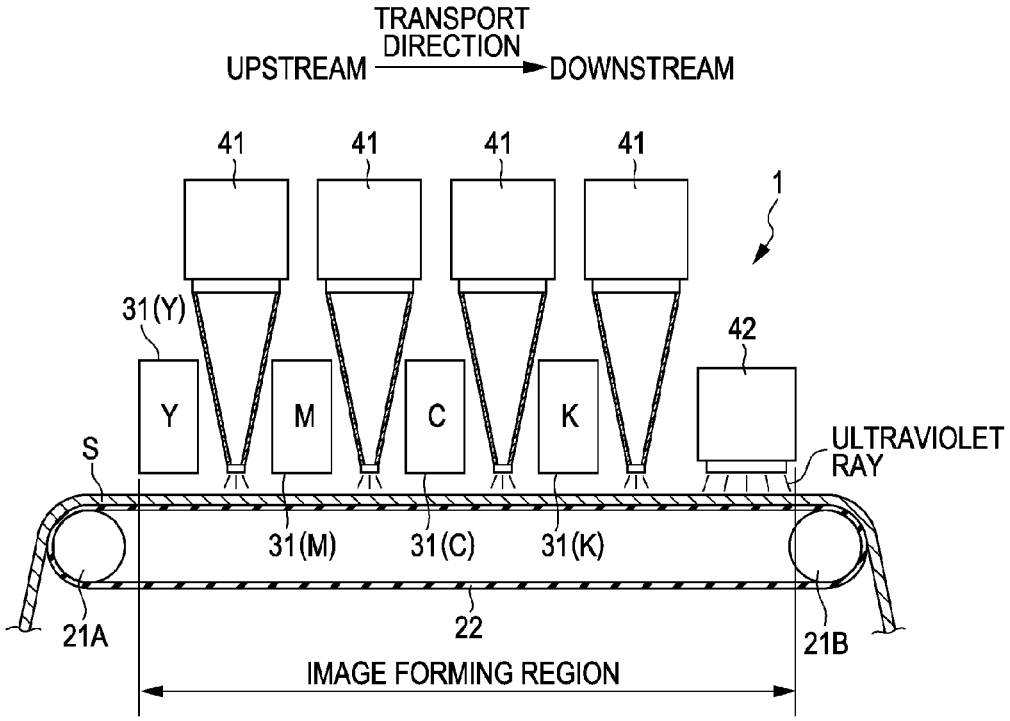
FIG. 2 is a schematic cross-sectional view of a printer.

FIG. 1 is a block diagram showing the configuration of a printing system and FIG. 2 is a schematic cross-sectional view of a printer 1. The printer 1 of the embodiment prints an image on a medium S (for example, paper, fabric, and film), using ink that is cured by radiating ultraviolet rays (light) (corresponding to "light-curable ink", hereafter referred to as "UV ink"). The UV ink contains ultraviolet curable resin and is cured by a photo-polymerization reaction in the ultraviolet curable resin when receiving ultraviolet rays. Further, the printer 1 of the embodiment uses continuous paper (roll paper) continuing in the transport direction of the medium S, as the medium S. However, the medium is not limited thereto and, for example, may be single sheet paper.

A computer 60 is connected with the printer 1 to be able to communicate and outputs print data for printing an image in the printer 1 to the printer 1. Further, a printer driver that converts image data output from an application program into print data is installed on the computer 60.

The printer 1 received print data from the computer 60 prints an image on the medium S by controlling the units with the controller 10. The detector group 50 monitors the situation in the printer 1 and the controller 10 controls the units on the basis of the detected result. An interface unit 11 in the controller 10 communicates data between the computer 60 that is an external device and the printer 1. A CPU 12 is a calculating device for controlling the entire printer 1 and controls the units with a unit control circuit 14. A memory 13 ensures a region for storing programs or a work region of the CPU 12.

A transporting unit 20, as shown in FIG. 2, includes transporting rollers 21A and 21B and a transporting belt 22. The medium S is transported downward in the transport direction (to a side in a predetermined direction) at a constant speed without stopping under a head 31 that discharges UV ink or radiating units 41 and 42 that radiate ultraviolet rays. Further, the medium S on the transporting belt 22 is suctioned or electrostatically suctioned, such that a positional deviation of the medium S is prevented.

A head unit 30 includes a plurality of heads 31 discharging UV ink. A yellow head 31(Y) discharging yellow UV ink, a magenta head 31(M) discharging magenta UV ink, a cyan head 31(C) discharging cyan UV ink, and a black head 31(K) discharging black UV ink are sequentially disposed from the upstream side in the transport direction.

A plurality of nozzles that discharges UV ink is aligned on the bottom (surface opposite to the medium S) of each of the heads 31, at predetermined intervals in the paper width direction crossing the transport direction (not shown). Therefore, UV ink is discharged from the head 31 while the medium S passes under the head 31, such that a plurality of dot lines is printed side by side in the paper width direction and a two-dimensional image is printed on the medium S.

Further, discharging the ink from the nozzles may be implemented by a piezo-method that discharges ink by expanding/contracting a pressure chamber filled with ink by applying a voltage to a driving element or a thermal method that discharges ink by using bubbles that are generated in the nozzles by a heating element.

A radiating section 40 cures the UV ink by radiating ultraviolet rays to the UV ink landed on the medium S and includes the preliminary radiating unit 41 and the main radiating unit 42. The preliminary radiating unit 41 and the main radiating unit 42 are light sources of ultraviolet rays, and for example, include a plurality of light emitting diodes (LED), or a metal halide lamp or a mercury lamp.

The lengths of the preliminary radiating unit 41 and the main radiating unit 42 are substantially the same as the length of the head 31 in the paper width direction. In other words, the lengths of the ultraviolet ray-radiation surfaces of the preliminary radiating unit 41 and the main radiating unit 42 in the paper width direction are not less than the length of the maximum image, which can be printed by the printer 1, in the paper width direction. Accordingly, ultraviolet rays are radiated to the UV ink discharged from the head 31, in the entire region in the paper width direction.

The preliminary radiating unit 41 preliminarily cures the UV ink by radiating ultraviolet rays such that the UV ink is not completely cured. Flow of the UV ink landed on the medium S (enlargement of the dots) is suppressed by the preliminary curing.

Further, in the printer 1 of the embodiment, as shown in FIG. 2, four heads 31 and four preliminary radiating units 41 are alternately disposed in the transport direction. Accordingly, the preliminary radiating units 41 cure the UV ink by radiating ultraviolet rays to the UV ink discharged from the head 31 at the immediately upstream side in the transport direction, before the head 31 at the immediate downstream side in the transport direction discharges UV ink. Therefore, it is possible to suppress mixing of color or blurring between UV ink having different colors and it is possible to improve the image quality of the image.

Finally, the main radiating unit 42 disposed at the furthest upstream side in the transport direction completely cures the four colors of UV ink by radiating ultraviolet rays to the four colors of UV ink such that the four colors of UV ink (YMCK) are completely cured. Accordingly, printing an image on the medium S is completed. Therefore, as shown in FIG. 2, the region from the yellow head 31(Y) positioned at the furthest upstream side in the transport direction to the main radiating unit 42 is called an "image forming region".

As described above, the preliminary radiating unit 41 does not completely cure the UV ink, but the main radiating unit 42 completely cures the UV ink. Therefore, the main radiating unit 42 has larger radiating energy ((mJ/cm$^2$) accumulated radiation amount of ultraviolet rays radiated to unit area) than the preliminary radiating unit 41. Further, the radiation energy (mJ/cm$^2$) is determined by multiply of radiation intensity of ultraviolet rays (mW/cm$^2$) and radiation times.

In conclusion, in the printer 1 of the embodiment, as the controller 10 (corresponding to a control unit) controls the head 31 to discharge UV ink to the medium S while moving the medium S downstream in the transport direction with respect to the heads 31 or the preliminary radiating unit 41 and the main radiating unit 42, the preliminary radiating unit 41 and the main radiating unit 42 radiates ultraviolet rays to the UV ink on the medium S. Accordingly, the printer 1 prints an image with the UV ink on the medium S.

Further, the invention is not limited to the printer 1, and for example, it may be possible to completely cure the UV ink with the radiating units disposed between the heads 31, without disposing the main radiating unit 42. Further, the colors of the UV ink discharged from the heads 31 may be the same. Further, for example, the yellow head 31(Y) corresponds to a first head, the magenta head 31(M) corresponds to a second head, and the preliminary radiating unit 41 between the yellow head 31(Y) and the magenta head 31(M) corresponds to a light radiating unit.

Arrangement of Head 31 and Preliminary Radiating Unit 41

Comparative Example

Figure 3:
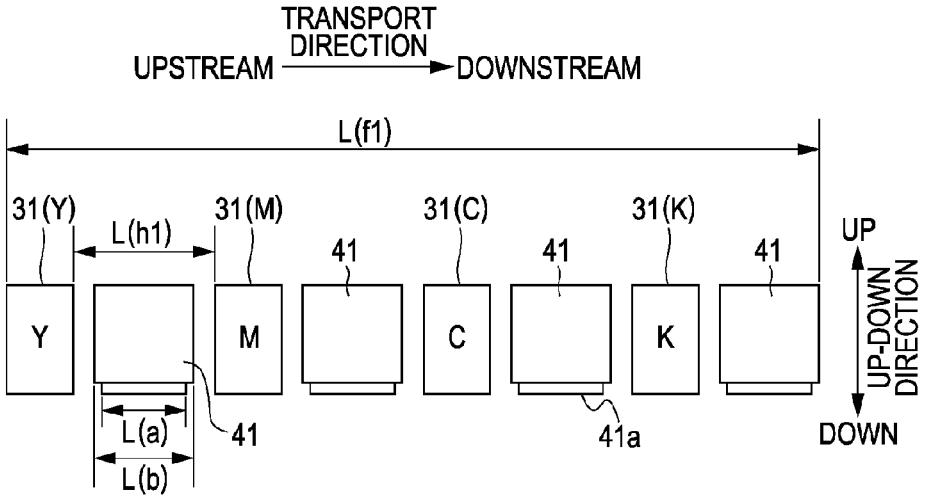
FIG. 3 is a view illustrating the arrangement of heads and preliminary radiating units in a comparative example.

FIG. 3 is a view illustrating the arrangement of the heads 31 and the preliminary radiating unit 41 in a comparative example. In this comparative example, the length of a radiation surface 41*a*, through which ultraviolet rays are radiated, of the preliminary radiating unit 41 in the transport direction, that is, the width of the radiation surface 41*a* is "L(a)". Further, the radiation surface 41*a* (corresponding to light radiation surface of the light radiating unit) is the surface, through which ultraviolet rays are radiated, of the preliminary radiating unit 41, for example, the surface where an LED is mounted. Further, the length of the preliminary radiating unit 41 in the transport direction, that is, the width of the preliminary radiating unit 41 is "L(b)". In this configuration, the width "L(b)" of the preliminary radiating unit 41 is the maximum width of the preliminary radiating unit 41. Further, the width of the preliminary radiating unit 41 is larger than the width of the radiation surface 41*a* (L(b)>L(a)).

In the comparative example, the heights (vertical positions) of the head 31 and the preliminary radiating unit 41 are substantially the same and the preliminary radiating units 41 are accommodated between the heads 31 aligned in the transport direction. That is, the upstream side surface of the preliminary radiating unit 41 is positioned downstream further than the downstream side surface of the upstream head 31 (for example, yellow head 31(Y)) in two heads 31 aligned in the transport direction with the preliminary radiating unit 41 therebetween while the downstream side surface of the preliminary radiating unit 41 is positioned upstream further than the upstream side surface of the downstream head 31 (for example, magenta head 31(M)).

Therefore, in the comparative example, the distance L(h1) in the transport direction between two heads 31 aligned in the transport direction with the preliminary radiating unit 41 therebetween is larger than the width L(b) of the preliminary radiating unit 41 (L(h1)>L(b)). That is, in the comparative example, the gap between the heads 31 aligned in the transport direction is relatively large.

The fact that the gap between the heads 31 aligned in the transport direction is large means that the length "L(f1)" in the transport direction from the yellow head 31(Y) at the furthest upstream side in the transport direction to the preliminary radiating unit 41 at the furthest downstream side in the transport direction is large and the length of the image forming region in the transport direction is large.

When the length of the image forming region in the transport direction is large, the gap between the transporting rollers 21A and 21B is large and the medium S transported in the image forming region easily makes a serpentine move. Accordingly, the UV ink discharged from the heads 31 is not landed to the correct positions on the medium S and the image quality is deteriorated.

In other words, when the length of the image forming region in the transport direction is large, it is necessary to dispose a mechanism for suppressing the serpentine move of the medium S (for example, a guide member for transporting the medium S or a sensor detecting the end in the paper width direction of the medium S), which increases the manufacturing cost of the printer 1.

Further, when the length of the image forming region in the transport direction is large, the width (the length in the transport direction) of the printer 1 increases, which increases the size of the printer 1.

It is an object to reduce the length of the image forming region in the transport direction, in the printer 1 of the embodiment.

Arrangement of Head 31 and Preliminary Radiating Unit 41

The Embodiment

Figure 4A:
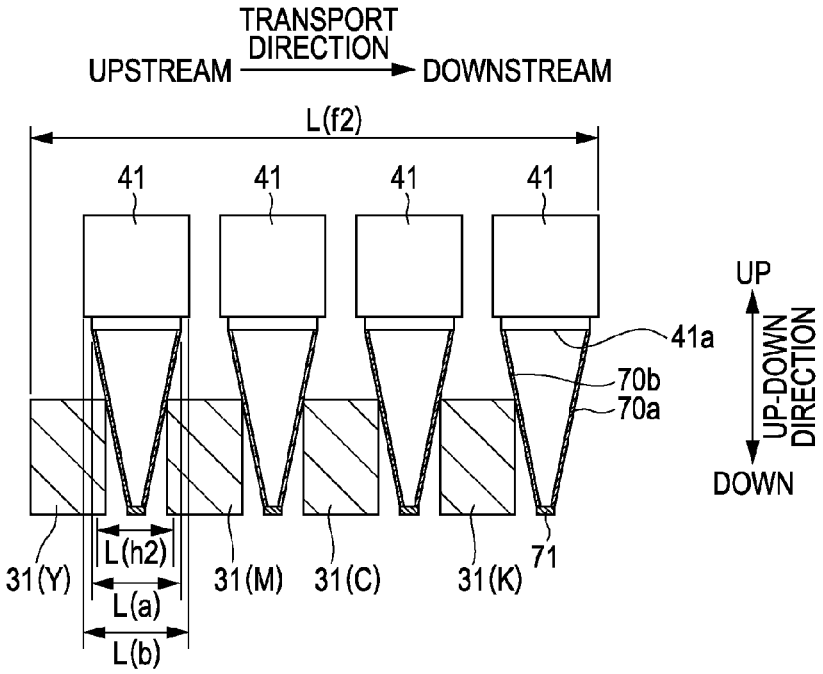
FIGS. 4A to 4C are views illustrating the arrangement of heads and preliminary radiating units in the embodiment.
Figure 4B:
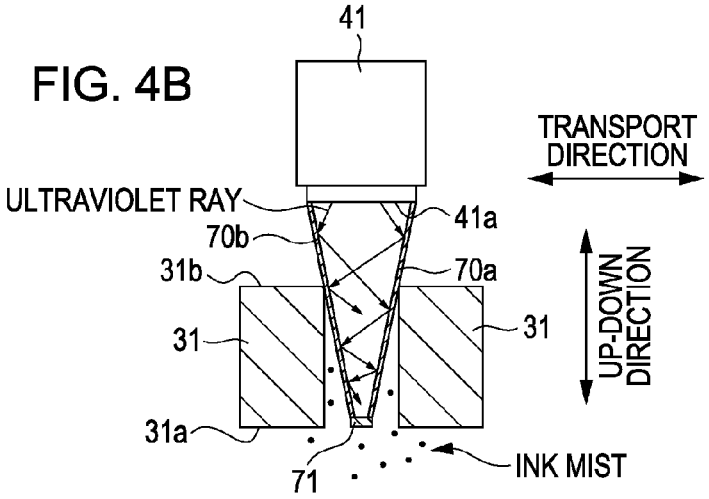
Figure 4C:
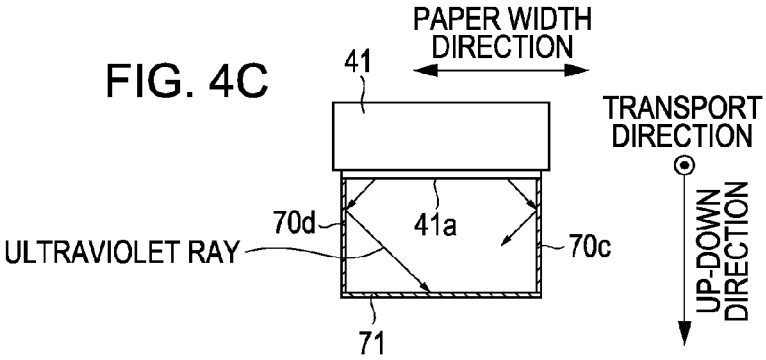

FIGS. 4A to 4C are views illustrating the arrangement of the heads 31 and preliminary radiating units 41 in the embodiment. FIG. 4A is a cross-sectional view of the heads 31 and the preliminary radiating units 41 seen from the paper width direction. In the embodiment the preliminary radiating units 41 are positioned vertically above (further away from the medium in the direction crossing the transport direction) the heads 31.

Further, the positions of the ends in the transport direction of the heads 31 and the positions of the ends in the transport direction of the preliminary radiating units 41 overlap each other. In detail, in two heads 31 aligned in the transport direction, the downstream side surface of the upstream head 31 is positioned downstream further than the upstream side surface of the preliminary radiating unit 41 between the two heads 31 and the upstream side surface of the downstream head 31 is positioned upstream further than the downstream side surface of the preliminary radiating unit 41. That is, the preliminary radiating unit 41 is not accommodated between the heads 31 aligned in the transport direction.

Therefore, in the embodiment, the length in the transport direction between two heads 31 aligned in the transport direction, that is, the head gap "L(h2)" is smaller than the width "L(b)" of the preliminary radiating unit 41. Further, in the embodiment, the head gap L(h2) is smaller than the width "L(a)" of the radiation surface 41*a* of the preliminary radiating unit 41.

That is, as in the printer 1 of the embodiment, since the preliminary radiating units 41 are shifted vertically above the heads 31, it is possible to make the head gap L(h2) smaller than the width L(b) of the preliminary radiating unit 41, without interfering the preliminary radiating unit 41 and the head 31.

Therefore, the head gap is smaller in the embodiment (FIG. 4A) than the comparative example (FIG. 3) (L(h1)>L(h2)). Therefore, the length in the transport direction from the yellow head 31(Y) to the preliminary radiating unit 41 at the furthest downstream side in the transport direction is small (L(f1)>L(f2)) in the embodiment in comparison to the comparative example, such that it is possible to make the length of the image forming region in the transport direction short. Further, as the head gap L(h2) is smaller than the width L(a) of the radiation surface 41*a* of the preliminary radiating unit 41, it is possible to make the length of the image forming region in the transport direction shorter.

Therefore, the transported medium S does not easily make a serpentine move in the image forming region in the embodiment in comparison to the comparative example, such that the transport accuracy is increased. Accordingly, deviation in the landed positions of the UV ink discharged from the head 31 is suppressed, such that the image quality of the image is improved. Further, it is not necessary to dispose a mechanism for preventing the serpentine move of the medium S, such that it is possible to suppress the manufacturing cost of the printer 1. Further, it is possible to reduce the width (length in the transport direction) of the printer 1, such that it is possible to suppress an increase in size of the printer 1.

Further, the temperature of the preliminary radiating unit 41 is relatively increased by the heat of the light source that radiates ultraviolet rays. Accordingly, as the preliminary radiating units 41 are vertically shifted with respect to the heads 31, the heat of the preliminary radiating units 41 is not easily transferred to the heads 31, such that it is possible to suppress the temperature of the heads 31 from increasing. Therefore, it is possible to suppress a change in viscosity of the UV ink discharged from the heads 31, such that it is possible to stabilize the amount of UV ink discharged from the heads 31. As a result, the image quality of the image is improved.

Further, since the preliminary radiating units 41 is positioned vertically above the heads 31, that is, shifted further away from the medium S (transporting belt 22), the heat of the preliminary radiating units 41 is not easily transferred to the medium S. Therefore, it is possible to suppress contraction of the medium S, such that it is possible to prevent deviation of the landed positions of the UV ink discharged from the heads 31. On the contrary, since the distance from the heads 31 (nozzle surfaces) to the medium S is small, it is possible to prevent deviation of the landed positions of the UV ink discharged from the heads 31. As a result, the image quality of the image is improved.

FIG. 4B is a view illustrating reflective plates 70*a* and 70*b*. A pair of reflective plates 70*a* and 70*b* (corresponding to light guiding units) that introduce ultraviolet rays (light) from the preliminary radiating unit 41 to the UV ink on the medium S positioned between two heads 31 aligned in the transport direction is disposed in the printer 1 of the embodiment. The pair of reflective plates 70*a* and 70*b* is disposed such that the surfaces through which ultraviolet rays are reflected are disposed opposite each other in the transport direction, such that they reflect the ultraviolet rays from the preliminary radiating unit 41 to each other. Further, the material of the reflective plates 70*a* and 70*b*, for example, may be a mirror made of aluminum or a material reflecting ultraviolet rays. Further, the pair of reflective plates 70*a* and 70*b* extend in the paper width direction, similar to the preliminary radiating unit 41, in accordance with the length in the paper width direction of the largest image that the printer 1 can print.

Further, the pair of reflective plates 70*a* and 70*b* is attached to the ends of the radiation surface 41*a* of the preliminary radiating unit 41 in the transport direction and extends downward from the radiation surface 41*a* to between the heads 31 aligned in the transport direction. Further, the pair of reflective plates 70*a* and 70*b* of the embodiment extend downward at the same height of the nozzle surface 31*a* of the head 31 from the radiation surface 41*a* (to the cover member 71).

Therefore, as shown in FIG. 4B, while reflecting from the pair of reflective plates 70*a* and 70*b* to each other, the ultraviolet rays radiated from the preliminary radiating unit 41 are guided down to between two heads 31 aligned in the transport direction, (onto the medium S). As a result, the ultraviolet rays radiated from the preliminary radiating unit 41 are finally guided to the UV ink on the medium S passing between two heads 31 aligned in the transport direction, such that the UV ink can be cured.

As described above, even if the preliminary radiating unit 41 is shifted upward with respect to the head 31 to reduce the head gap L(h2), the pair of reflective plates 70*a* and 70*b* are disposed, such that the ultraviolet rays from the preliminary radiating unit 41 can be guided to the UV ink on the medium through between the heads 31.

Further, when the ultraviolet rays from radiated the preliminary radiating unit 41 is not vertical parallel light, but dispersed light, some of the ultraviolet rays from the preliminary radiating unit 41 tend to travel outward (upstream and downstream in the transport direction) from between two heads 31 aligned in the transport direction. Since the pair of reflective plates 70*a* and 70*b* opposite to each other in the transport direction is disposed on the radiation surfaces 41*a*, the ultraviolet rays that tend to travel outward from between the two heads 31 can be reflected from the reflective plates 70*a* and 70*b* to be guided to the two heads 31. Therefore, it is possible to effectively use the ultraviolet rays from the preliminary radiating unit 41.

Further, the gap in the transport direction of the pair of reflective plates 70*a* and 70*b* at a predetermined vertical position is smaller than the gap in the transport direction of the pair of reflective plates 70*a* and 70*b* at a position above (further away from the medium than the predetermined position). In detail, the gap between the pair of reflective plates 70*a* and 70*b* in the transport direction gradually decreases downward to some extent. In other words, the downstream reflective plate 70*a* in the transport direction is positioned such that the upper portion is shifted downstream in the transport direction further than the lower portion while the upstream reflective plate 70*b* in the transport direction is positioned such that the upper portion is shifted upstream in the transport direction further than the lower portion.

As in the embodiment, when the head gap L(h2) is smaller than the width L(a) of the radiation surface 41*a* of the preliminary radiating unit 41, the end of the head 31 in the transport direction and the end of the radiation surface 41*a* in the transport direction are opposite to each other. Therefore, if the pair of reflective plates 70*a* and 70*b* are not provided, the ultraviolet rays from the end of the radiation surface 41*a* in the transport direction is radiated to the tops 31*b* of the heads 31.

Since the pair of reflective plates 70*a* and 70*b* of which the gap decreases downward in the transport direction to some extent are disposed, the ultraviolet rays from the end of the radiation surface 41 in the transport direction can be guided to between the two heads 31 aligned in the transport direction, such that it is possible to effectively use the ultraviolet rays from the preliminary radiating unit 41.

As described above, by the pair of reflective plates 70*a* and 70*b*, it is possible to cure the UV ink on the medium while effectively using the ultraviolet rays from the preliminary radiating unit 41. As the ultraviolet rays from the preliminary radiating unit 41 are effectively used, it is possible to increase radiation intensity of ultraviolet rays that are radiated to the UV ink on the medium. In other words, the loss of ultraviolet rays from the preliminary radiating unit 41 can be reduced by the pair of radiating plates 70*a* and 70*b*, such that it is possible to decrease the radiation intensity of ultraviolet rays which is set in the preliminary radiating unit 41. Therefore, it is possible to reduce, for example, the number of LEDs, which decreases the cost.

Further, the gap of the pair of reflective plates 70*a* and 70*b* in the transport direction decreases downward to some extent, from the preliminary radiating unit 41 at substantially the same height of the nozzle surface 31*a* of the head 31. Therefore, the ultraviolet rays can be concentrated downward to some extent, such that it is possible to increase the radiation intensity of the ultraviolet rays radiating to the UV ink on the medium. That is, by the pair of reflective plates 70*a* and 70*b*, it is possible to radiate ultraviolet rays to the UV ink while increasing the radiation intensity by concentrating the ultraviolet rays from the preliminary radiating unit 41.

Further, ink mist (fine ink drops that are not landed on the medium) floats around the head 31. When ink mist sticks to the radiation surface 41*a* of the preliminary radiating unit 41, the ink mist is cured on the radiation surface 41*a*, such that the amount of ultraviolet rays radiated to the UV ink on the medium decreases. Further, as the UV ink (ink mist) sticking to the radiation surface 41*a* is cured, it is difficult to remove the UV ink (cleaning work).

Cover members 71 (for example, glass) transmitting ultraviolet rays are attached to the lower ends (close to the medium) of the pair of reflective plates 70*a* and 70*b*, opposite to the radiation surface 41*a* of the preliminary radiating unit 41. Accordingly, the radiation surface 41*a* of the preliminary radiating unit 41 is surrounded by the pair of reflective plates 70*a* and 70*b* and the cover member 71, such that it is possible to suppress the ink mist from sticking to the radiation surface 41*a*. Further, the cover member 71 extends in the paper width direction, similar to the preliminary radiating unit 41 or the reflective plates 70*a* and 70*b*.

Further, it is preferable that the surface (at least one of the upper surface and the lower surface) of the cover member 71 which is opposite to the radiation surface 41*a* of the preliminary radiating unit 41 be machined for preventing transmission of infrared rays (for example, it is preferable to provide an infrared ray-cut filter). Accordingly, the heat of the preliminary radiating unit 41 is not easily transferred to the head 31 and it is possible to suppress the temperature of the head 31 from increasing. As a result, it is possible to suppress a change in viscosity of the UV ink discharged from the head 31, such that it is possible to stabilize the amount of UV ink discharged from the head 31.

Further, it is preferable that the surface (at least one of the upper surface and the lower surface) of the cover member 71 which is opposite to the radiation surface 41*a* of the preliminary radiating unit 41 be machined for preventing reflection of ultraviolet rays (for example, it is preferable to provide an anti-ultraviolet ray reflection filter). Accordingly, transmittance of ultraviolet rays of the cover member 71 increases and it is possible to increase the radiation intensity of the ultraviolet rays radiating to the UV ink on the medium.

FIG. 4C is a cross-sectional view of the preliminary radiating unit 41 and reflective plates 70*c* and 70*d*, seen in the transport direction. A pair of reflective plates 70*c* and 70*d* is attached to the end of the radiation surface 41*a* of the preliminary radiating unit 41 in the paper width direction such that surfaces through which ultraviolet rays are radiated are opposite to each other in the paper width direction. The pair of reflective plates 70*c* and 70*d* extends downward from the radiation surface 41*a* of the preliminary radiating unit 41 to the cover member 71. Further, the gap of the pair of reflective plates 70*c* and 70*d* in the paper width direction is uniform regardless of vertical positions.

As described above, as the reflective plates 70*c* and 70*d* are disposed opposite each other in the paper width direction, it is possible to reflect the ultraviolet rays, which tend to travel outward in the paper width direction of the radiation surface 41*a*, from the reflective plates 70*c* and 70*d* to be guided to the UV ink on the medium. Accordingly, it is possible to effectively use the ultraviolet rays from the preliminary radiating unit 41.

Further, the radiation surface 41*a* of the preliminary radiating unit 41 is surrounded by the pair of reflective plates 70*a* and 70*b* opposite to each other in the transport direction, the pair of reflective plates 70*c* and 70*d* opposite to each other in the paper width direction, and the cover member 71. Therefore, it is possible to suppress the ink mist from sticking to the radiation surface 41*a*.

However, the invention is not limited thereto, and for example, it may be possible to dispose the pair of reflective plates 70*a* and 70*b* in the transport direction, without disposing the pair of reflective plates 70*c* and 70*d* opposite to each other in the paper width direction and the cover member 71. Further, in order to guide the ultraviolet rays from the preliminary radiating unit 41 to the UV ink on the medium passing between two heads 31, the reflective plates 70*a* to 70*d* may be replaced by optic fibers or light guiding plates, for example. Further, the ultraviolet rays from the preliminary radiating unit 41 are vertical parallel right and the reflective plates 70*a* to 70*d* may be not be disposed when the head gap is not less than the width of the radiation surface 41*a*.

Modified Example 1

In the embodiment (FIGS. 4A to 4C) described above, the length L(h2) (head gap) in the transport direction between two heads 31 aligned in the transport direction is smaller than the width L(b) of the preliminary radiating unit 41 and smaller than the width L(a) of the radiation surface 41*a*.

The invention is not limited thereto, and the head gap L(h) may be smaller than the width L(b) of the preliminary radiating unit 41 and larger than the width L(a) of the radiation surface 41*a* (L(b)>L(h)>L(a)), the head gap L(h) may be the same as the width L(a) of the radiation surface 41*a* (L(b)>L(h)=L(a)), or the head gap L(h) may be the same as the width (L(b)) of the preliminary radiating unit 41 (L(b)=L(h)>L(a)).

In any case of them, the head gap is smaller than the comparative example (FIG. 3) in which the head gap L(h1) is larger than the width L(b) of the preliminary radiating unit 41. Therefore, it is possible to reduce the length of the image forming region in the transport direction.

Modified Example 2

Figure 5:
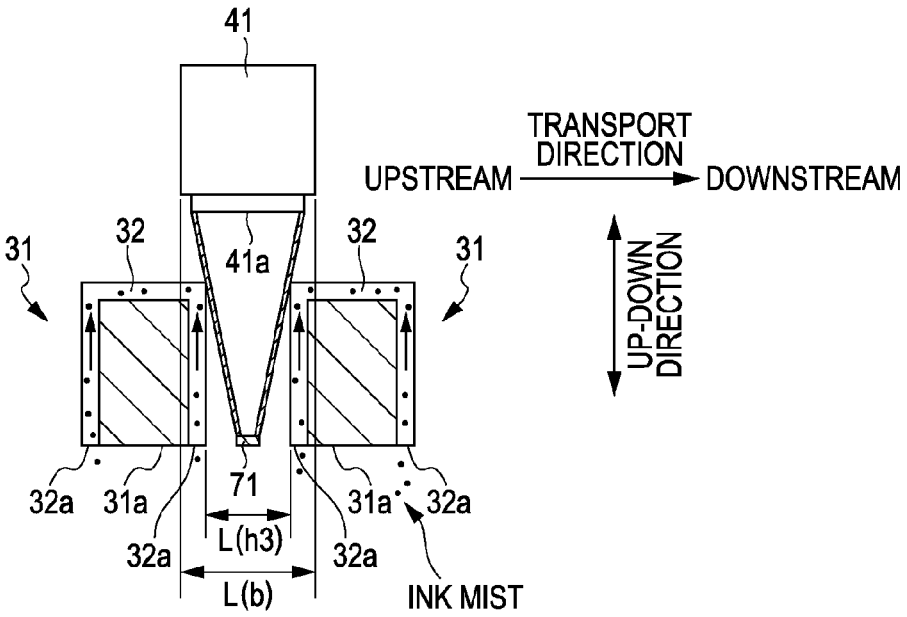
FIG. 5 is a view illustrating the arrangement of heads and preliminary radiating units in a modified example 2.

FIG. 5 is a view illustrating the arrangement of the heads 31 and the preliminary radiating unit 41 in the modified example 2. In the modified example 2 shown in FIG. 5, both ends of the heads 31 in the transport direction are collecting portions 32 that collect ink mist. For example, a negative pressure is made in the inside of the collecting portion 32 by an axial flow fan (not shown), such that it is possible to suction ink mist into the collecting portion 32 from an inlet 32*a* of the collecting portion 32. Accordingly, it is possible to suppress the ink mist from sticking to the radiation surface 41*a* of the preliminary radiating unit 41. However, the invention is not limited thereto, and for example, it may be possible to collect ink mist, using an electrostatic suction force.

As described above, even though a portion of the head 31 is the collecting portion 32 that collects ink mist, the distance in the transport direction between two heads 31 aligned in the transport direction, that is, the head gap L(h3) is not more than the width L(b) of the preliminary radiating unit 41 (L(h3)≤L(b)). In FIG. 5, since both ends of the head 31 in the transport direction are the collecting portions 32, the distance in the transport direction between the downstream end of the collecting portion 32 of the upstream head 31 in two heads 31 aligned in the transport direction and the upstream end of the collecting portion 32 of the downstream head 31 corresponds to the head gap L(h3).

Further, in the yellow head 31(Y) at the furthest upstream side in the transport direction, the collecting portion 32 (intake port 32*a*) may be disposed only at the downstream end in the transport direction.

Modified Example 3

Figure 6:
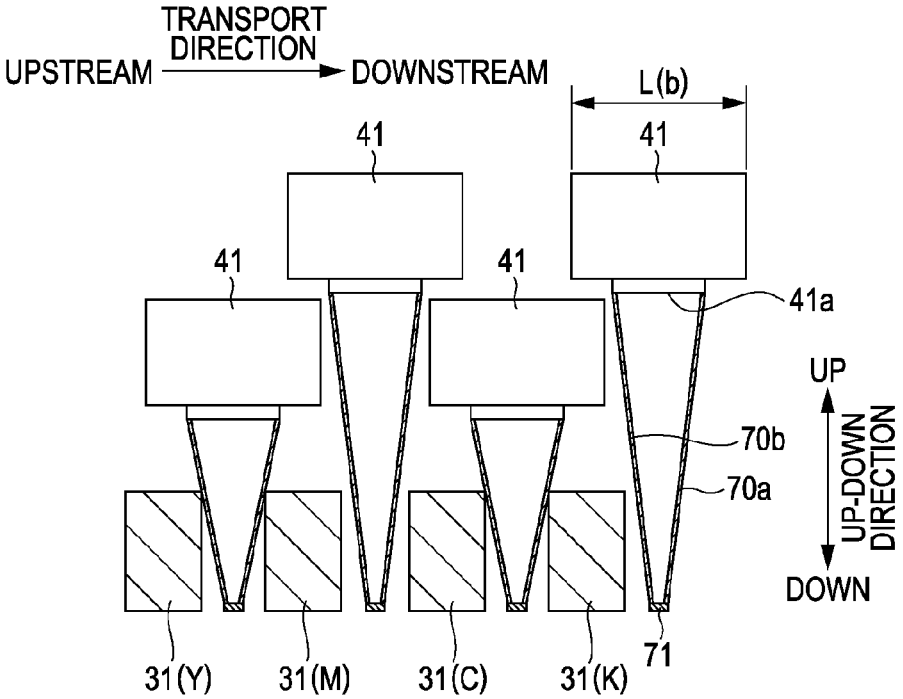
FIG. 6 is a view illustrating the arrangement of heads and preliminary radiating units in a modified example 3.

FIG. 6 is a view illustrating the arrangement of the heads 31 and the preliminary radiating unit 41 in the modified example 3. When the widths L(b) of the preliminary radiating units 41 are relatively long, when the vertical positions of the preliminary radiating units 41 are the same, as in the embodiment (FIG. 4A to 4C) described above, the preliminary radiating units 41 may interfere with each other. In this case, as shown in FIG. 6, it is preferable to shift the vertical positions of the preliminary radiating units 41.

Modified Example 4

Figure 7A:
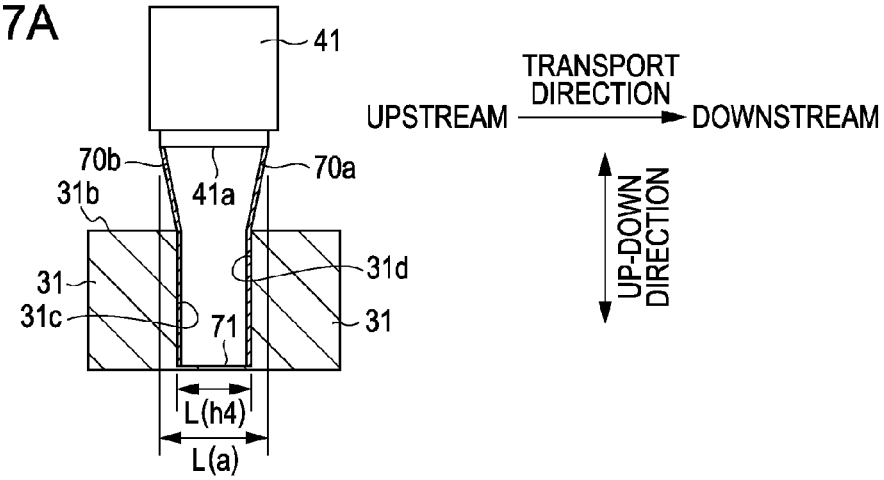
FIGS. 7A to 7C are views illustrating the arrangement of heads and preliminary radiating units in a modified example 4.
Figure 7B:
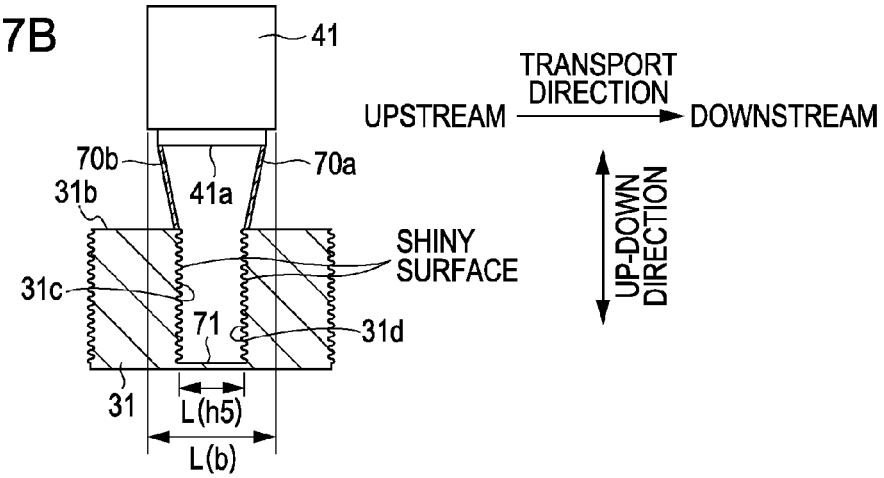
Figure 7C:
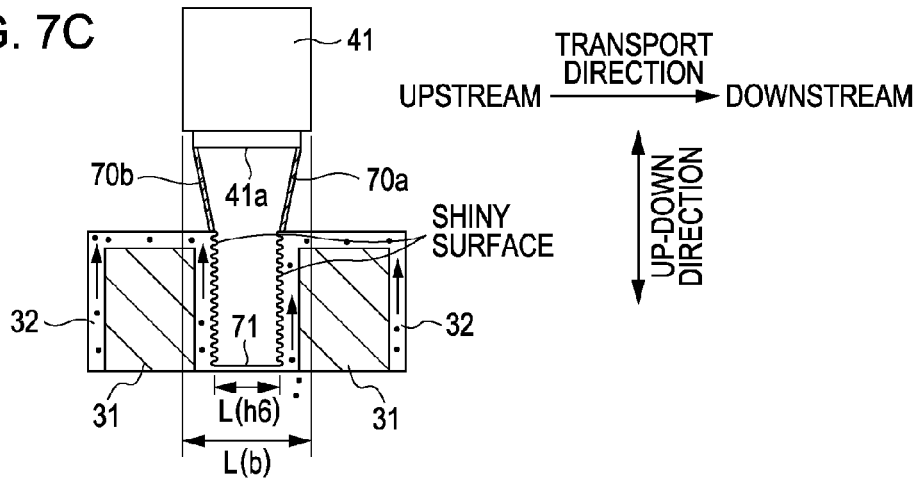

FIGS. 7A to 7C are views illustrating the arrangement of the heads 31 and preliminary radiating units 41 in the modified example 4. In the embodiment (FIGS. 4A to 4C) described above, the gap in the transport direction between the pair of reflective plates 70*a* and 70*b* opposite to each other in the transport direction gradually decreases downward to some extent from the radiation surface 41*a* to the cover member 71.

On the other hand, in a pair of reflective plates 70*a* and 70*b* in the modified example 4 shown in FIG. 7A, although the gap in the transport direction gradually decreases downward to some extent from the radiation surface 41*a* to the upper surface 31*b* of the head 31, the gap in the transport direction is constant from the upper surface 31*b* of the head 31 to the cover member 71. In FIG. 7A, the reflective plates 70*a* and 70*b* are partially attached to the sides 31*c* and 31*d* in the transport direction of the head 31.

In the reflective plates 70*a* and 70*b*, ultraviolet rays radiated from the preliminary reflective unit 41 are reflected from the pair of reflective plates 70*a* and 70*b* to each other and guided downward between the heads 31. As a result, it is possible to radiate ultraviolet rays to the UV ink on the medium passing between the heads 31.

Further, when the head gap L(h4) is smaller than the width L(a) of the radiation surface 41*a* of the preliminary radiating unit 41, the ultraviolet rays radiated from the end of the radiation surface 41*a* in the transport direction can be guided to between the heads 31. Further, when the ultraviolet rays from the preliminary radiating unit 41 are dispersed light, the ultraviolet rays tending to travel outward from between the heads 31 can be reflected from the reflective plates 70*a* and 70*b* and guided to between the heads 31. Accordingly, it is possible to effectively use the ultraviolet rays from the preliminary radiating unit 41.

However, the reflective plates 70*a* and 70*b* of the embodiment (FIGS. 4A to 4C) described above can further concentrate the ultraviolet rays from the preliminary radiating unit 41 in comparison to the reflective plates 70*a* and 70*b* of the modified example 4 (FIG. 7A), such that it is possible to increase the radiation intensity. Further, the reflective plates 70*a* and 70*b* of the modified example 4 can radiate ultraviolet rays to the UV ink on the medium S passing between the heads 31 for a longer time than the reflective plates 70*a* and 70*b* of the embodiment described above and it is possible to reduce the time until ultraviolet rays are radiated after the UV ink is discharged from the head 31. Therefore, it is preferable to use the reflective plates 70*a* and 70*b* that are suitable for radiation conditions of the UV ink used for printing.

In the modified example 4 shown in FIG. 7B, the pair of reflective plates 70*a* and 70*b* opposite to each other in the transport direction is not disposed outside the portion from the radiation surface 41*a* to the surface 31*b* of the head 31. However, in the modified example 4 shown in FIG. 7B, the sides 31*c* and 31*d* of the head 31 in the transport direction are shiny surfaces made of materials reflecting ultraviolet rays. In this case, similarly, the ultraviolet rays radiated from the preliminary radiating unit 41 are reflected from the pair of reflective plates 70*a* and 70*b* to each other and also reflected from the sides 31*c* and 31*d* of the heads 31, which are shiny surfaces, to each other, and are guided downward between the heads 31. As a result, it is possible to radiate ultraviolet rays to the UV ink on the medium passing between the heads 31.

Further, as shown in FIG. 7C, when both ends of the head 31 in the transport direction are collecting portions 32 that collect ink mist, the sides of the collecting portions 32 in the transport direction may be shiny surfaces made of materials reflecting ultraviolet rays.

Further, in the yellow head 31(Y) at the furthest upstream side in the transport direction, at least the downward side of the head 31 (or collecting portion 32) in the transport direction may be a shiny surface and the downward reflective plate 70*a* in the pair of reflective plates 70*a* and 70*b* attached to the preliminary radiating unit 41 at the furthest downstream side may be formed in the same shape as the reflective plate 70*a* shown in FIG. 7A or the reflective plate 70*a* shown in FIG. 5.

Modified Example 5

Figure 8:
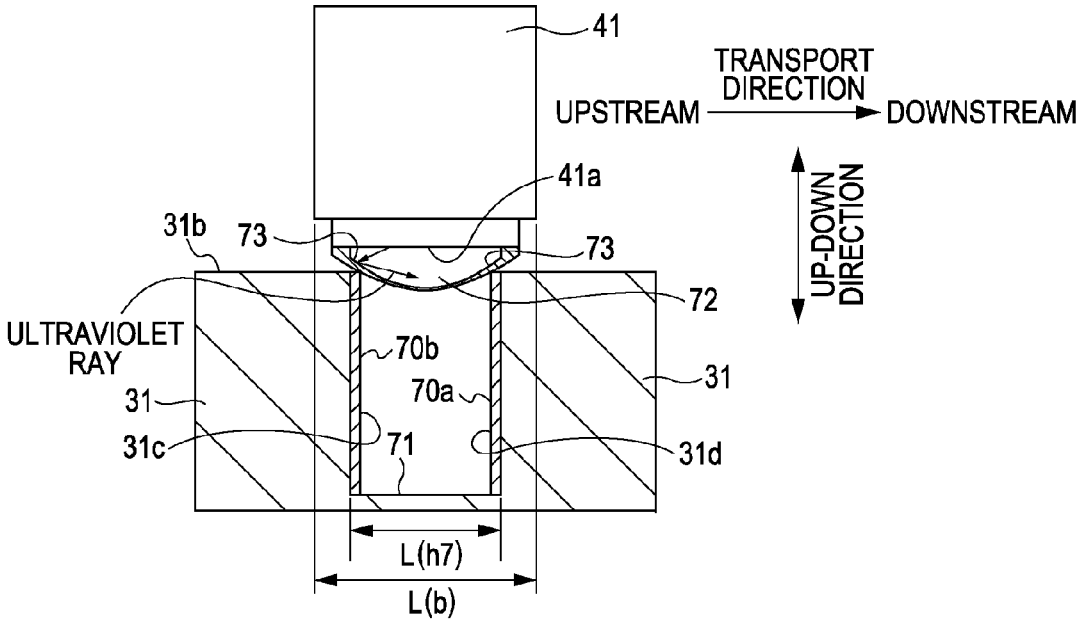
FIG. 8 is a view illustrating the arrangement of heads and preliminary radiating units in a modified example 5.

FIG. 8 is a view illustrating the arrangement of the heads 31 and the preliminary radiating unit 41 in the modified example 5. In the embodiment (FIGS. 4A to 4C) described above, the ultraviolet rays from the preliminary radiating unit 41 are guided to between the heads 31 by the pair of reflective plates 70*a* and 70*b* opposite to each other in the transport direction. On the other hand, in the modified example 5, a condenser lens 72 is attached to the radiation surface 41*a* of the preliminary radiating unit 41. Further, the pair of reflective plates 70*a* and 70*b* opposite to each other in the transport direction is attached to the sides 31*c* and 31*d* of the head 31 in the transport direction.

Further, the condensing lens 72 is attached such that the focal point of the condenser lens 72 is positioned vertically at the side of the medium (opposite to the radiation surface 41*a*). Accordingly, a convex lens is attached to the radiation surface 41*a*, with the curved surface facing the medium. Therefore, in FIG. 8, the ultraviolet rays from the radiation surface 41*a* are concentrated between the heads 31 by the condenser lens 72. However, the invention is not limited thereto, and for example, a biconvex lens may be attached to the radiation surface 41*a*.

In this case, it is also possible to guide the ultraviolet rays from the preliminary radiating unit 41 to the UV ink on the medium passing between the heads 31, using the condenser lens 72 and the pair of reflective plates 70*a* and 70*b*. Further, since the ultraviolet rays are concentrated by the condenser lens 72, the radiation intensity of the ultraviolet rays radiated to the UV ink can be increased.

Further, a reflective portion 73 reflecting ultraviolet rays may be disposed around the portion of the condenser lens 72 from the radiation surface 41*a* to the upper surface 31*b* of the head 31. Therefore, the ultraviolet rays that tend to travel outward from between the heads 31 can be reflected from the reflective portion 73 to be guided to between the heads 31. Therefore, it is possible to effectively use the ultraviolet rays from the preliminary radiating unit 41.

Modified Example 6

Figure 9:
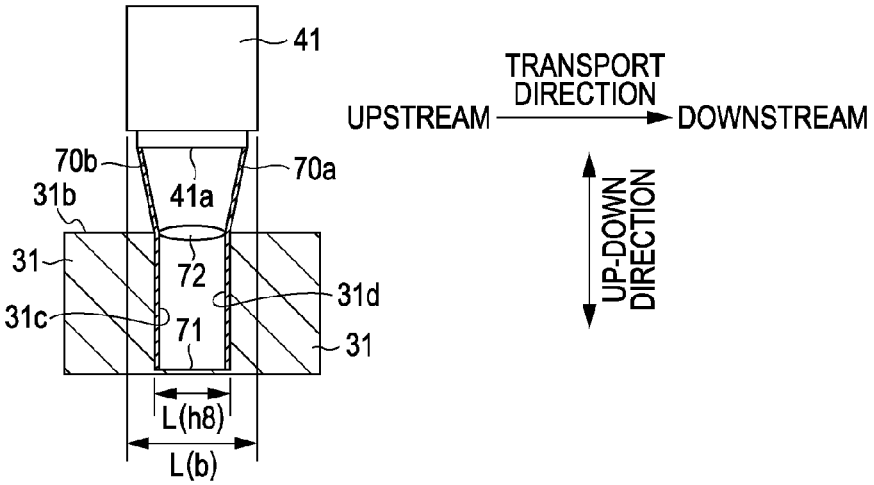
FIG. 9 is a view illustrating the arrangement of heads and preliminary radiating units in a modified example 6.

FIG. 9 is a view illustrating the arrangement of the heads 31 and the preliminary radiating unit 41 in the modified example 6. In the modified example 6, similar to the modified example 4 of FIG. 7A, a pair of reflective plates 70*a* and 70*b* is disposed. Further, in the modified example 6, a condenser lens 72 (biconvex lens in FIG. 9) that concentrates ultraviolet rays from the preliminary radiating unit 41 to the medium is disposed between the pair of reflective plates 70*a* and 70*b*.

In this case, it is possible to guide the ultraviolet rays from the preliminary radiating unit 41 to the UV ink on the medium passing between the heads 31, using the condenser lens 72 and the pair of reflective plates 70*a* and 70*b*. Further, since the ultraviolet rays are concentrated by the condenser lens 72, the radiation intensity of the ultraviolet rays radiated to the UV ink can be increased.

Modified Example 7

Figure 10:
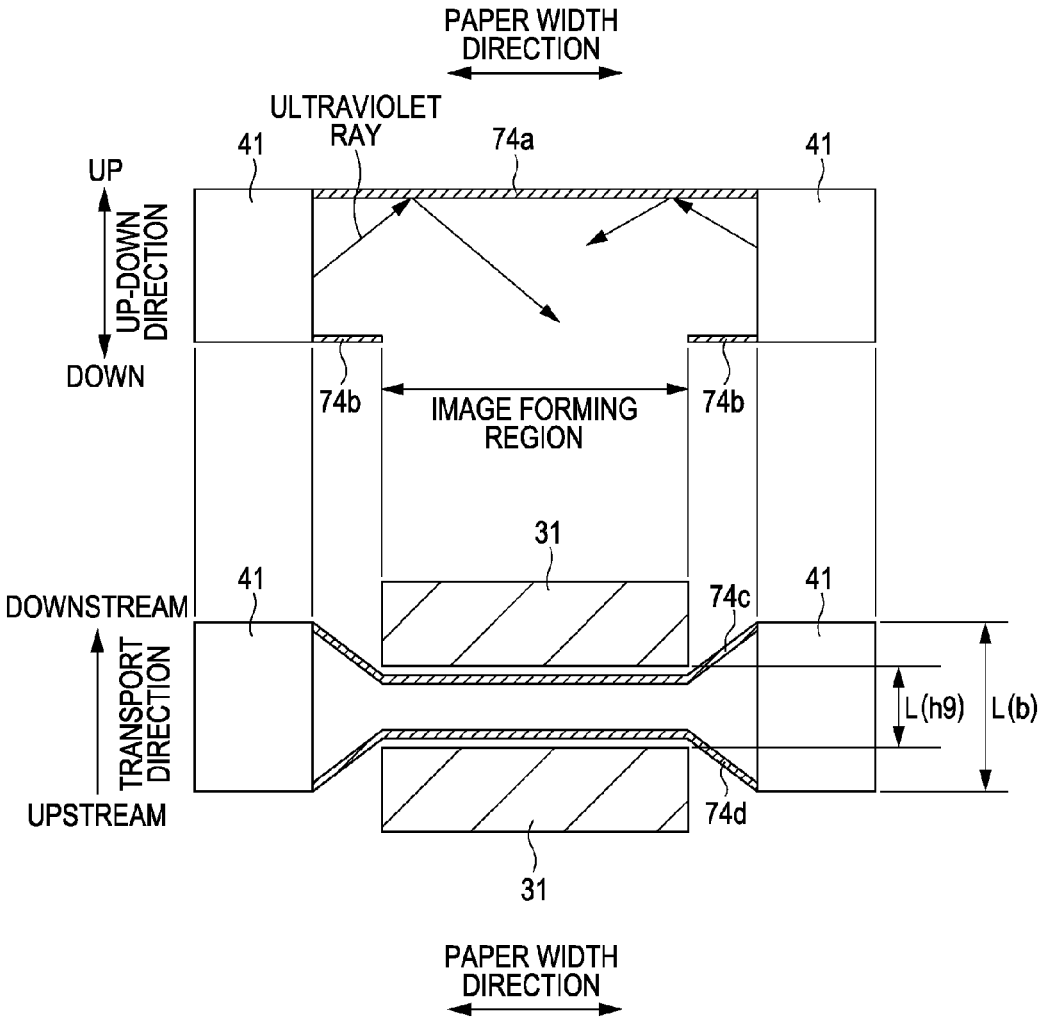
FIG. 10 is a view illustrating the arrangement of heads and preliminary radiating units in a modified example 7.

FIG. 10 is a view illustrating the arrangement of the heads 31 and the preliminary radiating unit 41 in the modified example 7. The preliminary radiating units 41 are vertically shifted with respect to the heads 31 such that the head gaps decrease in the example described above. On the other hand, in the modified example 7, the preliminary radiating units 41 are shifted in the paper width direction (the direction crossing the transport direction) with respect to the heads 31.

In this case, the preliminary radiating unit 41 is also not accommodated between two heads 31 aligned in the transport direction, such that it is possible to make the length (head gap) L(h9) in the transport direction between two heads 31 aligned in the transport direction smaller than the width L(b) of the preliminary radiating unit 41. Therefore, it is possible to reduce the length of the image forming region in the transport direction.

In FIG. 10, two preliminary radiating units 41 are disposed for the head 31 at both sides in the paper width direction, and as shown at the upper portion in FIG. 10, a reflective plate 74*a* reflecting ultraviolet rays is disposed from the upper surface of a preliminary radiating unit 41 to the upper surface of the other preliminary radiating unit 41. Therefore, when ultraviolet rays are radiated upward from the preliminary radiating units 41 in the center direction of the two preliminary radiating units 41, the ultraviolet rays are reflected from the reflective plate 74 at the upper portion and guided to the UV ink on the medium at the lower portion. Accordingly, it is possible to radiate ultraviolet rays from the preliminary radiating units 41 to the UV ink on the medium passing between the heads 31.

In order to guide the ultraviolet rays from the preliminary radiating unit 41 to the UV ink on the medium passing between the heads 31, in addition to the upper reflective plate 74*a*, a lower reflective plate 74*b* opposite to a portion of the upper reflective plate 74*a* or a pair of reflective plates 74*c* and 74*d* opposite to each other in the transport direction may be disposed.

Other Embodiments

Although a typical printing system equipped with an ink jet printer (image forming apparatus) was described in the embodiments described above, the embodiments are provided for easy understanding of the invention, not limiting the invention. The invention may be changed and modified without departing from the spirit and the equivalents are included in the invention.

Printer

Although the embodiment described above exemplify the printer 1 that discharges UV ink from the fixed heads 31 when the medium passes under the heads 31 or the preliminary radiating units 41, the invention is not limited thereto. For example, a printer that repeats an operation that forms an image while moving the heads with a nozzle line and preliminary radiating units alternately aligned in a movement direction crossing the direction of the nozzle line and an operation that transports a medium in the direction of a nozzle line may be used.

Ink

Although the embodiments described above exemplify ultraviolet curable ink as light-curable ink discharged from the heads 31, the invention is not limited thereto. For example, an image forming apparatus that discharges ink that is cured by radiating visible light from the heads, and radiates visible light from radiation units may be used.

What is claimed is:

1. An image forming apparatus comprising:

a first head that discharges first light-curable ink;

a light radiating unit that is positioned at one side from the first head in a predetermined direction and cures the first light-curable ink by radiating light to the first light-curable ink;

a second head that is positioned at the one side from the light radiating unit in the predetermined direction and discharges second light-curable ink;

a light guiding unit that guides the light from light radiating unit to a surface of a medium that receives the first and second light-curable ink, the light guiding unit having a first end adjacent a light emitting surface of the light radiating unit and a second end that is positioned between the first and second heads; and a control unit that causes an image to be formed on the medium by controlling the first head and the second head while moving the position of the medium relative to the first head, the light radiating unit, and the second head to the one side in the predetermined direction, wherein the length between the first head and the second head in the predetermined direction with the light radiating unit being between the first and second heads is less than the length of the light radiating unit in the predetermined direction, wherein the light radiating surface of the light radiating unit and the first end of the light guiding unit are located farther from the medium in a direction perpendicular to the surface of the medium than the first and second heads.

2. The image forming apparatus according to claim 1, wherein the distance between the first head and the second head in the predetermined direction is less than the length of a light radiating surface of the light radiating unit in the predetermined direction.

3. The image forming apparatus according to claim 1, wherein the light radiating unit is shifted in a direction crossing the predetermined direction, with respect to the first head and the second head.

4. The image forming apparatus according to claim 1, wherein the light guiding unit has a pair of reflective plates with the surfaces, which reflect the light from the light radiating unit, opposite to each other in the predetermined direction.

5. The image forming apparatus according to claim 4, wherein the light radiating unit is shifted away from the medium in the direction crossing the predetermined direction, with respect to the first head and the second head, and the gap of the pair of reflective plates in the predetermined direction at predetermined position in the crossing direction, is smaller than the gap of the pair of reflective plates in the predetermined direction at a position away from the predetermined position in the crossing direction.

6. The image forming apparatus according to claim 1, wherein the light guiding unit includes a lens concentrating light from the light radiating unit.

* * * * *